US012523134B2

(12) United States Patent
Kalenchuk et al.

(10) Patent No.: US 12,523,134 B2
(45) Date of Patent: Jan. 13, 2026

(54) METHOD FOR ACIDIZING A FORMATION

(71) Applicant: OVINTIV CANADA ULC, Calgary (CA)

(72) Inventors: Ashley Cameron Kalenchuk, Calgary (CA); John Michael Green, Calgary (CA); Blaine Richard Roth, Calgary (CA); David Maceachern Thompson, Calgary (CA)

( * ) Notice: Subject to any disclaimer, the term of this patent is extended or adjusted under 35 U.S.C. 154(b) by 0 days.

(21) Appl. No.: 18/592,785

(22) Filed: Mar. 1, 2024

(65) Prior Publication Data

US 2024/0295168 A1 Sep. 5, 2024

Related U.S. Application Data

(60) Provisional application No. 63/488,271, filed on Mar. 3, 2023.

(51) Int. Cl.

| | |
|---|---|
| ***E21B 43/27*** | (2006.01) |
| ***E21B 23/06*** | (2006.01) |
| ***E21B 43/116*** | (2006.01) |
| ***E21B 43/267*** | (2006.01) |

(52) U.S. Cl.
CPC ..... *E21B 43/27* (2020.05); *E21B 23/06* (2013.01); *E21B 43/116* (2013.01); *E21B 43/267* (2013.01)

(58) Field of Classification Search
CPC ..... E21B 23/06; E21B 43/267
See application file for complete search history.

(56) References Cited

U.S. PATENT DOCUMENTS

| | | | |
|---|---|---|---|
| 3,517,745 | A | 6/1970 | Suman, Jr. |
| 5,131,472 | A | 7/1992 | Dees et al. |
| 5,669,448 | A | 9/1997 | Minthorn et al. |
| 7,182,138 | B2 | 2/2007 | Behrmann et al. |
| 7,878,246 | B2 | 2/2011 | Samuel et al. |
| 9,944,843 | B2 | 4/2018 | Conway |
| 10,633,575 | B2 | 4/2020 | Conway |
| 10,697,282 | B2 | 6/2020 | Conway et al. |
| 11,168,246 | B2 | 11/2021 | Purdy et al. |
| 11,485,902 | B2 | 11/2022 | Purdy et al. |
| 11,492,542 | B2 | 11/2022 | Purdy et al. |
| 2004/0099418 | A1 | 5/2004 | Behrmann et al. |

(Continued)

FOREIGN PATENT DOCUMENTS

| | | | |
|---|---|---|---|
| CA | 2656344 | C | 8/2009 |
| CA | 2999197 | A1 | 6/2017 |

(Continued)

OTHER PUBLICATIONS

Salah, Mohamed et al., Evaluation of Multistage Fracturing Stimulation Horizontal Well Completion Methods in Western Desert, Egypt, Society of Petroleum Engineers, SPE-183785-MS, Mar. 2017, pp. 1-22, Manama, Kingdom of Bahrain.

(Continued)

*Primary Examiner* — Silvana C Runyan
(74) *Attorney, Agent, or Firm* — HEER LAW; Christopher D. Heer

(57) ABSTRACT

A method for perforating a formation and stimulating the formation with an acidic composition is provided. In particular, the method comprises using a separation layer to separate the acidic composition from perforating tools during perforation. The present invention can be used in combination with fracturing such as hydraulic fracturing.

25 Claims, 3 Drawing Sheets

(56) References Cited

U.S. PATENT DOCUMENTS

| | | | | |
|---|---|---|---|---|
| 2005/0123437 | A1 | 6/2005 | Cassidy et al. | |
| 2006/0042797 | A1* | 3/2006 | Fredd | E21B 43/26 166/312 |
| 2006/0243443 | A1 | 11/2006 | Matthews | |
| 2011/0155375 | A1 | 6/2011 | Griffith | |
| 2014/0151043 | A1* | 6/2014 | Miller | E21B 47/13 166/281 |
| 2015/0047838 | A1 | 2/2015 | Lecerf et al. | |
| 2015/0275605 | A1* | 10/2015 | Bennett | E21B 10/32 166/55.1 |
| 2016/0049725 | A1 | 2/2016 | Dupuy et al. | |
| 2019/0234177 | A1* | 8/2019 | Silva | E21B 23/01 |
| 2021/0131261 | A1* | 5/2021 | Wang | E21B 49/006 |
| 2021/0189855 | A1 | 6/2021 | Purdy et al. | |
| 2021/0230476 | A1 | 7/2021 | Purdy et al. | |
| 2022/0049156 | A1 | 2/2022 | Purdy et al. | |

FOREIGN PATENT DOCUMENTS

| | | | |
|---|---|---|---|
| CA | 3042913 | C | 9/2019 |
| CA | 3060195 | | 9/2019 |
| CA | 3004675 | A1 | 11/2019 |
| WO | 2016049742 | A1 | 4/2016 |
| WO | 2016049744 | A1 | 4/2016 |
| WO | 2016089394 | A1 | 6/2016 |
| WO | 2019213739 | A1 | 11/2019 |

OTHER PUBLICATIONS

McElfresh, Paul et al., A Novel Method of Preventing Perforation Damage in High-Temperature Offshore Wells, Society of Petroleum Engineers, SPE 86521, Feb. 2004, pp. 1-5, Lafayette, Louisiana, USA.

* cited by examiner

METHOD FOR ACIDIZING A FORMATION

BENEFIT OF EARLIER APPLICATIONS

This application claims priority from U.S. provisional application No. 63/488,271, filed Mar. 3, 2023.

FIELD OF THE INVENTION

The present application relates generally to a method for perforating a formation and stimulating the formation with an acidic composition (also referred to herein as "acidizing"). The present invention can be used in combination with fracturing, such as hydraulic fracturing.

BACKGROUND OF THE INVENTION

Oil and gas operators have used acid treatment, or acidizing, to improve well productivity for more than 100 years. However, until the early 1930's, acidizing use was limited by the lack of effective acid corrosion inhibitors to protect the steel tubulars in the wells. With the development of effective corrosion inhibitors, the use and further development of acid treatment of oil and gas wells proliferated. Today, acidizing is one of the most widely used and effective means available to oil and gas operators for improving productivity (stimulation) of wells. Acidizing is commonly performed on new wells to maximize their initial productivity and on aging wells to restore productivity and maximize the recovery of oil and gas (*Acidizing; Treatment of Oil and Gas Operators*, American Petroleum Institute (2014)).

There are three general categories of acid treatment: acid washing; matrix acidizing; and fracture acidizing. The most common type of acid used in the industry is hydrochloric acid (HCl), which reacts with carbonate, sandstone, shale and the like. Often, with more complex geologic formations, a combination of hydrochloric acid and hydrofluoric acid are used. Other types of acids include organic acids such as acetic acid and formic acid as alternatives to hydrochloric acid. It has also been noted that mixtures of these conventional acids with sulphamic, sulphuric, phosphoric, methanesulphonic, nitric, citric, and chloroacetic acids are employed. Nevertheless, the majority of acidizing treatments carried out utilize HCl at concentrations of 5-28%. HCl has an advantage over the other mineral acids in the acidizing operation because it forms metal chlorides, which are very soluble in the aqueous phase.

Often, these acid solutions will also comprise a corrosion inhibitor (CI) to control the corrosion damage of well tubulars, mixing tanks, coiled tubings, and other metallic surfaces. A variety of organic compounds act as CIs for steels during the acidizing procedure, including acetylenic alcohols, aromatic aldehydes, alkenylphenones, amines, amides, nitrogen-containing heterocycles (e.g. imidazoline-based), nitriles, imminium salts, triazoles, pyridine and its derivatives or salts, quinoline derivatives, thiourea derivatives, thiosemicarbazide, thiocyanates, quaternary salts, and condensation products of carbonyls and amines. Molecules containing nitrogen and acetylenic alcohols are claimed to form a film on the metal surface and can retard the metal dissolution process (an anodic reaction) as well as hydrogen evolution (a cathodic reaction). However, it has been reported that propargyl alcohol is soluble in acids, but the solubility of other acetylenic alcohols decreases with increasing carbon chain length. On the other hand, the solubility of such acetylenic alcohols can be increased when combined with quaternary ammonium surfactants. Acetylenic alcohols are widely used because of their commercial availability and cost effectiveness. Propargyl alcohol is usually taken as a standard CI for acidization and sometimes it has a significant synergistic effect with other compounds. However, the most commonly used CIs in the natural resource exploitation industry are propargyl alcohol and its derivatives, cinnamaldehyde, and nitrogen aromatic-based compounds such as pyridinium benzyl quaternary chloride (Matjaz Finsgar and Jennifer Jackson, *Application of corrosion inhibitors for steels in acidic media for the oil and gas industry: A review*, Corrosion Science 86 (2014) 17-41).

Acidizing is often used in combination with hydraulic fracturing techniques. In fracture acidizing treatments, the one or more fractures are created in the formation and acidic solution is introduced into the fracture to etch flow channels in the fracture face. The acid also enlarges the pore spaces in the fracture face and in the formation.

The use of horizontal drilling technology in hydrocarbon production operations has gained popularity over the past two decades. Therefore, new completion technologies have been developed to provide multi-stage fracturing. One of the most commonly used completion technique is commonly referred to as "plug and perf". This type of completion generally involves first cementing production casing (steel pipe) in the horizontal wellbore followed by stimulation. During plug and perf operations, a tool assembly consisting of, but not limited to, perforation gun(s) and a plug (isolation plug) are deployed into the well via wireline, coiled tubing and the like. In horizontal or deviated wells, pumping the tool assembly in place is a key operation to get the tool assembly at the desired position in the well. Once the tool assembly is in place, then the plug is set and released from the tool assembly. The perf guns are pulled back into the desired position and fired to establish communication from the wellbore to the formation.

Generally, the first fracture stage near the toe of a horizontal well is accessed by a burst port or by conveying the perforation tools on coil tubing or a tractor. Once fracturing is completed by activating the perforation tool, the perforation tool is removed from the wellbore. Once the first fracture stage is completed, a coiled tubing or wireline is deployed into the well equipped with a bottom hole assembly comprising at least a perforation tool (e.g., perforation gun) and a plug to allow the next fracture stage. The plug is set and released from the perforation tool and the perforation tool is pulled to a planned depth and activated. The perforation tool is removed from the wellbore and a second coiled tubing or wireline is deployed into the well equipped with a perforation tool (e.g., perforation gun) and a plug to allow the next fracture stage.

Past acid deployment into wells has typically been a separate stage of the operation than perforating. However, more efficient developments which relate to methods for simultaneously perforating a wellbore and treating the perforated area with a treatment fluid such as acid, have been developed such that there is a simultaneous presence of a perforation tool (gun) downhole in the presence of an acidic composition (see, for example, U.S. Patent Application Publication No. 2005/0123437, U.S. Patent Application Publication No. 2004/0099418 and Canadian Patent Application No. 3,042,913). However, despite the advances made in the use of a corrosion inhibitor for use in acid injection operations to reduce corrosion on typically oilfield grade steel, it is still desirable to prevent downhole tools such as perforating tools (e.g., perforating guns) from continuous, long-term exposure to acidic solutions. Further, having the acid present during actual perforation tends to result in the acid losing its strength, resulting in the acid losing much of its effectiveness.

The present invention addresses the issues of overexposure of downhole tools to acid and the loss of acid strength.

SUMMARY OF THE INVENTION

The current application is directed to a method for perforating and acidizing a formation while overcoming some of the shortcomings of the prior art. The method can be used alone or in combination with fracturing such as hydraulic fracturing. The present method can be used to acidize vertical wells, deviated wells and horizontal wells. The method can be used for acidizing hydrocarbon bearing formations, water bearing formations (aquifiers), and the like.

In particular, in the present invention, the acid is separated from the down hole tools (e.g., perforating guns) during perforation operations to (1) protect the down hole tools; and (2) to allow the acid to maintain its strength and effectiveness, as it does not contact or react with the perforations and formation, until the acid is displaced into the perforations and formation to allow acidizing to occur. Further, by not allowing the acid to contact the perforations and formation until the acid is displaced avoids any possible formation damage that can be caused during extended acid soak times, such as secondary reactions, precipitations, emulsions or formation sloughing.

Thus, broadly stated, in one aspect of the present invention, a method for acidizing a formation is provided comprising:

- providing a wellbore in the formation;
- conveying a bottom hole assembly (BHA), said BHA at least comprising at least one perforating tool and a bridge plug, into the wellbore by means of a carrier line, including a wireline, a slick line, or coiled tubing, until the BHA reaches a desired location in the wellbore;
- pumping a volume of a separation fluid into the wellbore sufficient to submerge the BHA in the separation fluid;
- pumping a volume of an acidic composition to form a layer of acidic composition above the separation fluid;
- setting and shearing the bridge plug from the BHA;
- positioning the at least one perforating tool of the BHA at a desired location in the wellbore requiring acidizing while ensuring that the BHA is still substantially separated from the acidic composition;
- activating the at least one perforation tool to perforate the wellbore and create perforations into the surrounding formation;
- removing the remaining tools of the BHA and carrier line from the wellbore; and
- pumping a volume of a displacement fluid into the wellbore to displace the separation fluid and allow the acidic composition to reach the perforations for acidizing the formation.

In one embodiment, the wellbore is a horizontal wellbore and the separation fluid is also used to displace the BHA into the wellbore to the desired location in the wellbore while still ensuring the BHA is submerged in the separation fluid. In one embodiment, the first volume of displacement fluid is added after the pumping of the acidic composition to further aid in displacing the BHA at the desired location in the wellbore while still ensuring that the BHA is submerged in the separation fluid.

In one embodiment, the displacement fluid is a fracturing fluid and, optionally, a proppant, that is pumped into the wellbore to both displace the acidic composition into the perforations to acidize the formation and to further fracture the perforations after acidizing to form fractures. In one embodiment, the displacement fluid comprises a second volume of separation fluid followed by a fracturing fluid and, optionally, a proppant. In one embodiment, the first and second separation fluid comprises water.

In one embodiment, the wellbore is flushed with clean water when fracturing is completed. In one embodiment, the method is repeated until a desired area of the formation is perforated, acidized and fractured. In one embodiment, the wellbore is a horizontal wellbore and substantially the entire length of the horizontal portion of the horizontal well is perforated, acidized and fractured. In one embodiment, the wellbore is a deviated wellbore. In one embodiment, the wellbore is a vertical wellbore. In one embodiment, the first or second separation fluid is selected from the group consisting of water, produced water (high salinity brine), friction reduced water, a gas including $CO_2$, $N_2$ and methane, a produced oil, frac oil, solvent, condensate, methanol, foam base fluids, surfactant based fluid and gelled water. In one embodiment, the displacement fluid is selected from the group consisting of water, produced water (high salinity brine), friction reduced water, a gas including $CO_2$, $N_2$ and methane, a produced oil, frac oil, solvent, condensate, methanol, foam base fluids, surfactant based fluid and gelled water. In one embodiment, the acidic composition comprises hydrochloric acid, hydrofluoric acid, an organic acid such as acetic acid or formic acid, or a combination thereof. In one embodiment, the acidic composition further comprises a corrosion inhibitor. In one embodiment, the fracturing fluid is selected from the group consisting of friction reduced water, also referred to as slick water, high viscosity friction reduced (HVFR) water, linear gelled (guar, cellulose, xanthan, hydroxyethyl cellulose (HEC) polyacrylamide, hydroxypropyl guar (HPG), carboxymethyl hydroxypropyl guar (CMHPG)) water, gelled oil, crosslinked (borate, zirconium, titanate) gelled water, $CO_2$ polyemulsion or foamed water, $N_2$ foamed water, gelled methanol, oil/water polyemulsions and surfactant based fluids.

In one embodiment, the proppant is selected from the group consisting of sand, treated sand or man-made ceramic materials.

In one embodiment, the wellbore comprises a production casing. In one embodiment, the production casing is a steel pipe. In one embodiment, the production casing is cemented in place in the formation. In one embodiment, the at least one perforating tool is a perforating gun.

Additional aspects and advantages of the present invention will be apparent in view of the description, which follows. It should be understood, however, that the detailed description and the specific examples, while indicating preferred embodiments of the invention, are given by way of illustration only, since various changes and modifications will become apparent to those skilled in the art from this detailed description. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

(a) FIG. 1A. illustrates the first steps of an embodiment of the present invention for acidizing a formation in a horizontal well.

(b)

DETAILED DESCRIPTION OF PREFERRED EMBODIMENTS

Figure 1A:
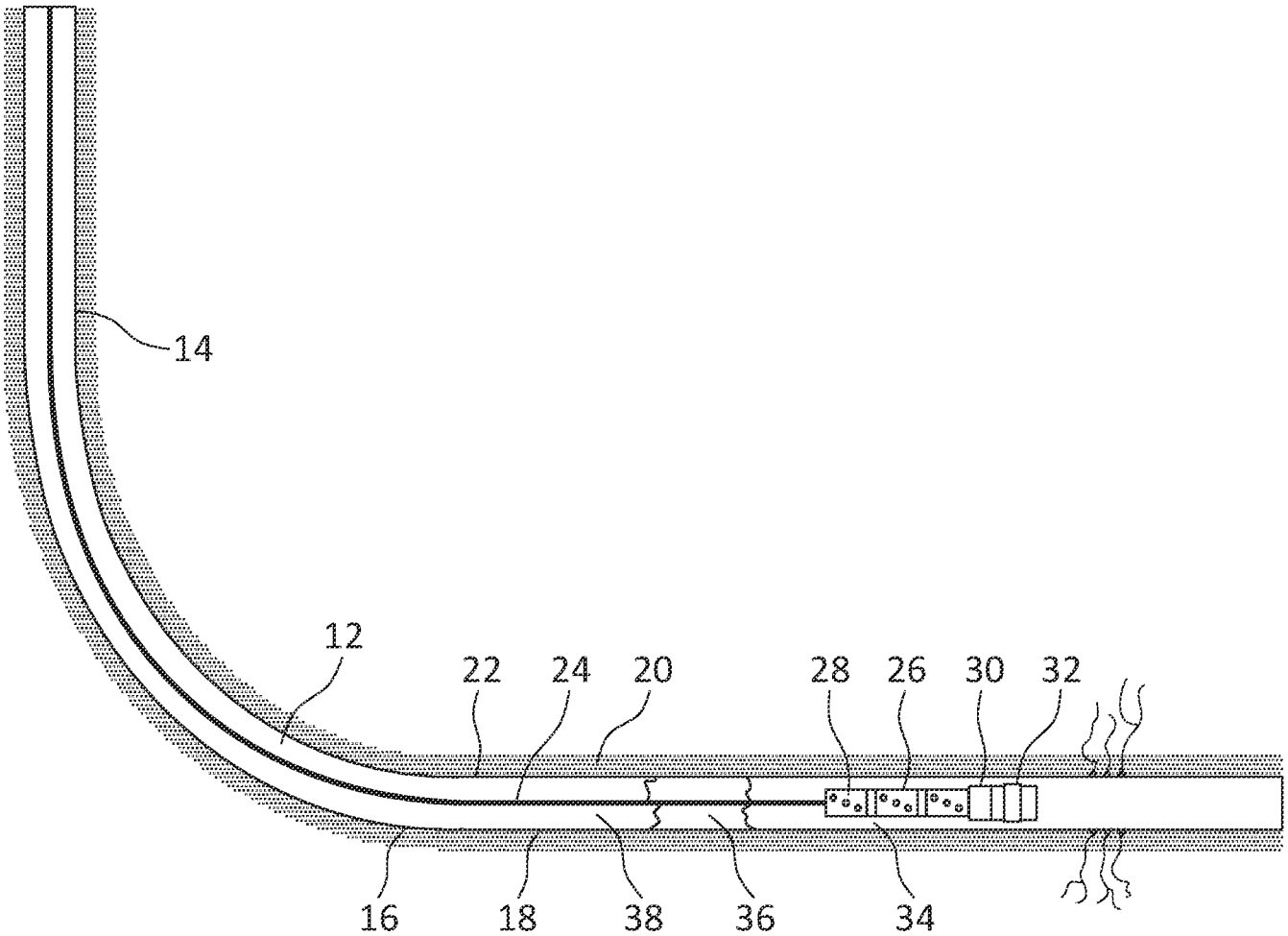
FIG. 1B illustrates the second steps following the first steps as illustrated in FIG. 1A for acidizing a formation in a horizontal well; and (c)
FIG. 1C shows fracturing the horizontal well in an embodiment where acidizing and fracture are combined according to one embodiment of the present invention.

The detailed description set forth below in connection with the appended drawings is intended as a description of various embodiments of the present application and is not intended to represent the only embodiments contemplated. The detailed description includes specific details for the purpose of providing a comprehensive understanding of the present application. However, it will be apparent to those skilled in the art that the present application may be practised without these specific details.

As used herein, "perforating tool" refers to a tool capable of punching through the well casing to reach the reservoir of oil or gas on the other side and include perforating guns, firing head perforators and the like. Perforating guns contain several shaped explosive charges and are available in a range of sizes and configurations. The diameter of the gun used is typically determined by the presence of wellbore restrictions or limitations imposed by the surface equipment.

As used herein, "bridge plug" is a downhole tool that is located and set to isolate the lower part of the wellbore. Bridge plugs may be permanent or retrievable, enabling the lower wellbore to be permanently sealed from production or temporarily isolated from a treatment conducted on an upper zone.

As used herein, "setting tool" is another term for running tool, a generic name for a tool or device that is used in the placement or setting of downhole equipment such as permanent packers or plugs. The running tool can be retrieved after the operation or setting process.

As used herein, "corrosion inhibitor" are generally organic compounds that act to prevent corrosion of steels during the acidizing procedure, including acetylenic alcohols, aromatic aldehydes, alkenylphenones, amines, amides, nitrogen-containing heterocycles (e.g. imidazoline-based), nitriles, imminium salts, triazoles, pyridine and its derivatives or salts, quinoline derivatives, thiourea derivatives, thiosemicarbazide, thiocyanates, quaternary salts, and condensation products of carbonyls and amines.

The current application is directed to a method for perforating and acidizing a formation, which method can be used either alone or in combination with fracturing such as hydraulic fracturing. In the present invention, the acid is separated from the down hole tools (e.g., perforating guns) during perforation operations to (1) protect the down hole tools; and (2) to allow the acid to maintain its strength and effectiveness, as it does not contact or react with the perforations and formation, until the acid is displaced into the perforations and formation to allow acidizing to occur. Further, by not allowing the acid to contact the perforations and formation until the acid is displaced avoids any possible formation damage that can be caused during extended acid soak times, such as secondary reactions, precipitations, emulsions or formation sloughing.

Further, the present invention uses a separation fluid to separate the acid from any residual fluid in the wellbore prior to pumping acid into the wellbore. This separation fluid ensures no adverse reaction occurs between the acid and the residual fluid in the well. Previous experience has shown that without the use of a separation fluid, the acid can adversely react with existing fluids in the wellbore and cause unwanted emulsions, crosslinking or precipitates to occur.

In particular, it was discovered by the present applicant that when acid was pumped into a wellbore, without the use of a separation fluid, the acid reacted with the anionic friction reducer based water present in the well and crosslinked the fluids to create a highly viscous, doughy-like structure. This, in turn, caused significant damage to the formation and impairment of the well such that expensive interventions were attempted to recover the well with no avail. Metals, like iron, are well known in the oil and gas industry to be good at building viscosity by way of crosslinking the fluid, however, in this case, it was learned very quickly that a separation fluid was required to ensure that these unwanted reactions do not take place.

The present invention can be used to acidize vertical wells, deviated wells and horizontal wells. As merely being exemplary, the invention will be described herein by referring to FIGS. 1A to 1C, which illustrate a horizontal well.

FIG. 1A illustrates a horizontal well 10 comprising wellbore 12, vertical portion 14, deviation heel 16 and horizontal portion 18. Wellbore 12 is shown extending through formation 20, which will be perforated and acidized according to the present invention. Wellbore 12 is preferably cased in a casing 22, which may be a steel tubing, and is cemented into place as is well known in the art. A bottom hole assembly (BHA) 26 is illustrated in FIG. 1A as having been lowered and deployed into the horizontal portion 18 by means of a carrier line 24, which carrier line can be a cable, wireline, slick-line, coiled tubing and the like. The BHA 26 is positioned in the wellbore 12 at a desired position in the wellbore 12 for perforating formation 20, as will be further described.

In particular, in the embodiment shown in FIG. 1A, BHA 26 comprises a multistage perforation gun 28, which, as illustrated in FIG. 1A, comprises three connected perforation guns. However, it is understood a single perforating gun or other multistage perforating guns can also be used. It is also understood that the carrier line 24 may include the necessary electrical, mechanical or hydraulic conduits to activate multistage perforation gun 28. It is further understood that other perforators could also be used such as bullet perforators, shaped charge perforators and the like. Finally, it is understood that the multistage perforation gun 28 is capable of penetrating both casing and cement and thereby forming perforations in the formation 20.

In the embodiment shown in FIG. 1A, BHA 26 further comprises a bridge plug 32 (also referred to in the industry as a frac plug). There are many different kinds of frac plugs known in the art can be used in the present invention. BHA 26 further comprises setting tool 30. Setting tools are designed to set bridge plugs and the like and many different types of setting tools, e.g., hydraulic setting tools, electronic setting tools, wireline setting tools and the like, all of which are well known in the art, can be used to set plugs such as bridge plugs.

As can be seen in FIG. 1A, separator fluid 34 is first pumped downhole to cover the BHA 26 such that the BHA 26 is entirely submerged in separator fluid 34. The separator fluid 34 also aids in positioning the BHA 26 at the desired position in the wellbore 12. Next, an acid composition 36 is pumped downhole such that the acid 36 is layered on top of separator fluid 34 and is well distanced from BHA 26. In one embodiment, a portion of displacement fluid 38 is added after the acidic composition 36 layer to further position the BHA 26 at the desired position while still ensuring that the acidic composition 36 layer is separated from the acidic composition 36 layer.

By having the acidic composition 36 separated from the BHA 26 and the area of the formation that is to be perforated, this allows the acidic composition to maintain its strength and effectiveness. It was discovered by the present applicant that when the acid is located in the casing and not exposed to the perforations, any cement on the outside of the casing or the formation, it's not reacting with any substances until it's operationally required. With acid in contact with the perforations, the acid can then react with the substances such as perforations, any cement on the outside of the casing or the formation, thereby losing some of it's strength or causing formation damage. There is some period of time between placing the acid in the wellbore to when the fracturing operations commences. This amount of time varies, but with plug and perf operations, for example, the carrier line and BHA are removed from the wellbore before fracturing operations commence. This amount of time has proven to be enough time to reduce the effectiveness of the acid if the acid is in contact with the perforations prior to fracturing operations commencing and therefore has shown to have a negative impact on fracturing operations and efficiencies. In some instances, more acid was required to be pumped during fracturing operations to effectively stimulate the formation.

Figure 1B:
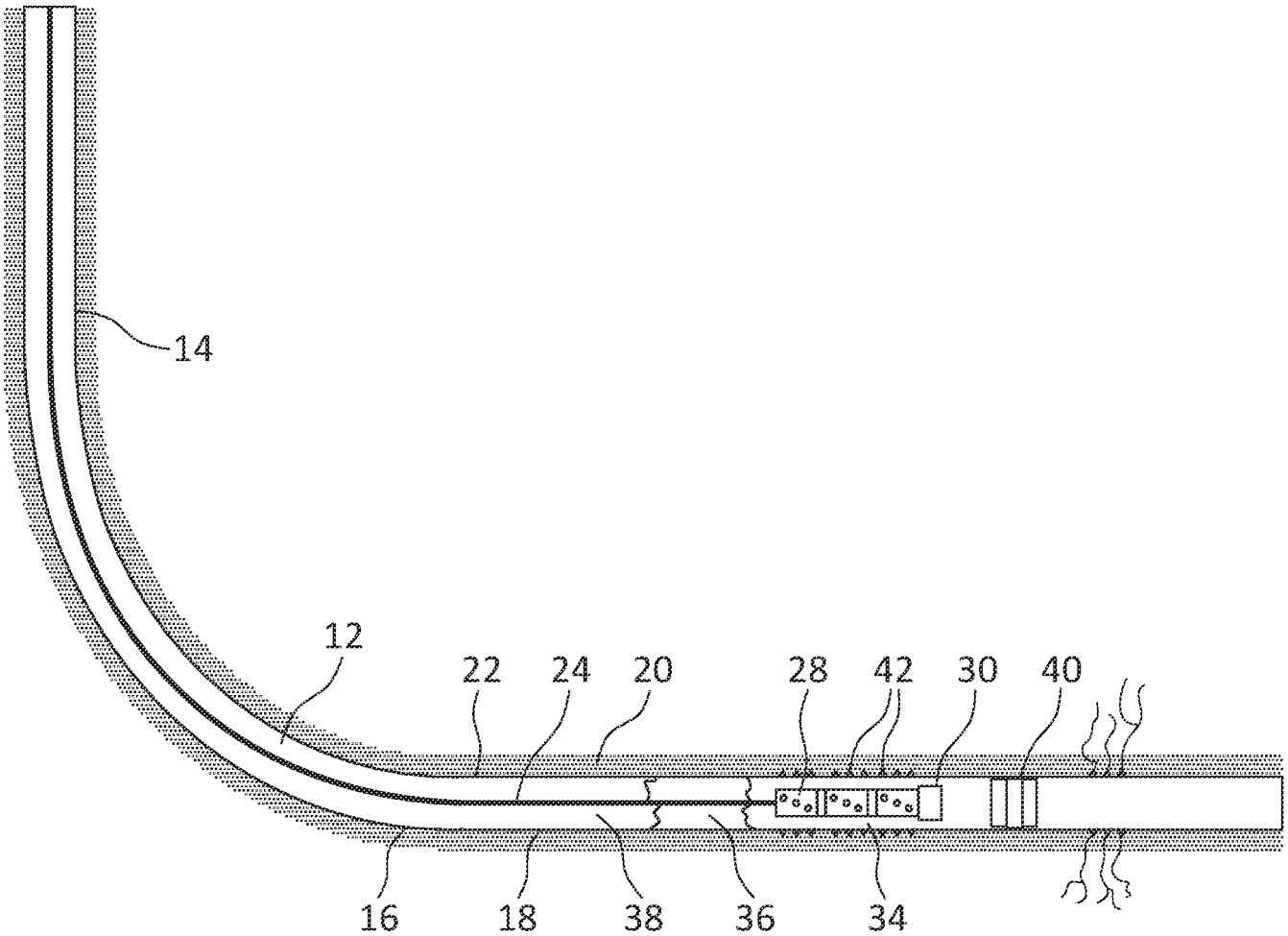

Turning now to FIG. 1B, once the separation fluid 34 and acidic composition 36 has been pumped down the wellbore, the setting tool 30 is activated to set bridge plug 32 to form set bridge plug 40 and shears and disconnects set bridge plug 40 from the BHA 26. The multistage perforation gun 28 is then positioned at a desired location in the wellbore 12 and the multistage perforating gun is activated to perforate the well casing 22 (and cement, if well casing 22 is cemented in place within the wellbore 12) to form perforations 42 that extend into communication with the formation 20. It should be emphasized that, as shown in FIG. 1B, at all times during the perforation operation, the perforation gun 28 and setting tool 30 are still fully submerged in separation fluid 34. After the perforation operation is completed, the spent multistage perforation gun and setting tool are now removed from the wellbore 12 and displacement fluid 38 is pumped downhole to displace the separation fluid 34 and allow the acidic composition 36 to reach the perforations 42 for acidizing the formation (if fractures are not desired for the completion being effective). Thus, the BHA 26 has minimal interaction with the acidic composition 36.

Figure 1C:
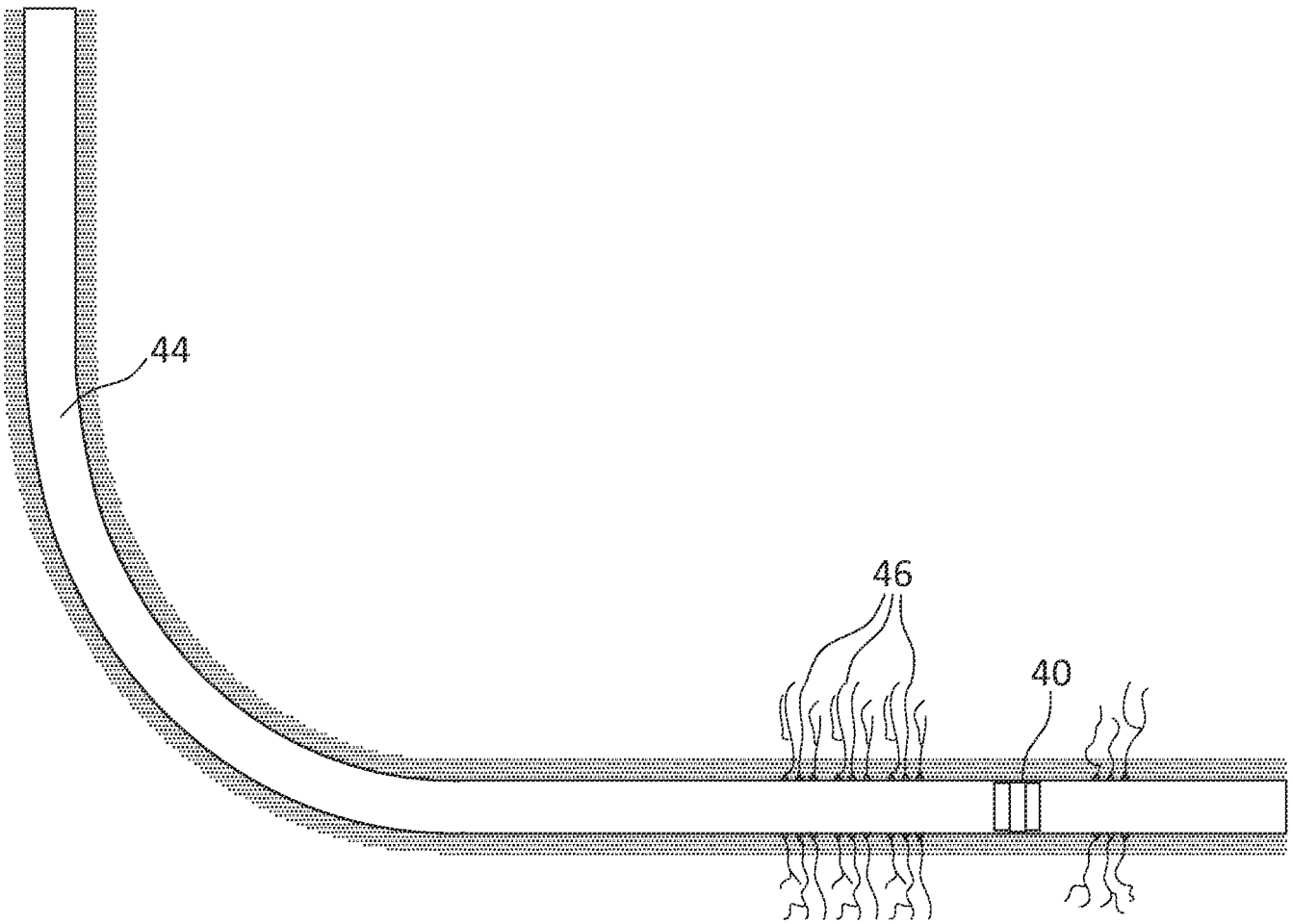

In one embodiment, as shown in FIG. 1C, acidizing is coupled with fracturing the well. In particular, in this instance, fracturing fluid 44 is pumped down instead of displacement fluid 38 to both displace the separation fluid 34 and the acidic composition 36 to allow the acidic composition 36 to reach the perforations 42 for acidizing the formation and to further propagate the perforations 42 to form fractures 46. In one embodiment (not shown), both displacement fluid 38, followed by fracturing fluid 44 are used to allow the acidic composition 36 to reach the perforations 42 for acidizing the formation and to further propagate the perforations 42 to form fractures 46.

The following Examples of the present invention involved horizontal wells, however, it is understood that the present invention could be used with vertical wells and deviated wells, as well.

Example 1

In a horizontal well, a bottom hole assembly (BHA) comprising a multistage perforating gun and a bridge (frac) plug was positioned in the horizontal portion of the well. Pumps were then engaged to pump down the separation fluid (water) at a pumping rate of 1.0 $m^3$/min at 2,230 m at 20 MPa and then increased to 2.0 $m^3$/min at 17.1 MPa. 8.0 $m^3$ of separation fluid was pumped at a pump rate of 2.0 $m^3$/min at 17.1 MPa and then the pump rate was reduced to 0.5 $m^3$/min and 5 $m^3$ of acid was pumped. Displacement fluid (water) was then pumped for acid displacement at a pump rate of 2.0 $m^3$/min. All pumps were then shut down and, at this point, a total of 37.2 $m^3$ of water had been used.

The bridge plug was then set at a depth measurement (KB) measured in meters (m) of 3,624.0 mKB. The multistage perforation gun was then pulled up and the formation was first perforated at 3,618.0-3,618.25 mKB. This "pull and perf" procedure was repeated seven more times at depth intervals of 3,606.0-3,606.25 mKB, 3,594.0-3,594.25 mKB, 3,582.0-3,582.25 mKB, 3,570.0-3,570.25 mKB, 3,558.0-3,558.25 mKB, 3,546.0-3,546.25 mKB, and 3,534.0-3,534.25 mKB. After perforation was completed, the BHA was pulled to the surface and removed from the wellbore. At this point, the open casing pressure was 16.6 MPa. Pumping of fracturing fluid (slick water) was then commenced, increasing fluid rates up to 7.2 $m^3$/min, FTP+38.0 MPa, followed by a slick water scour→25-250 kg/$m^3$, 50/140 sand (34.0 tonnes), FTR=11.5 $m^3$/min, FTP=54.0 MPa and slick water sand→250-400 kg/$m^3$, 40/70 sand (134.0 tonnes), FTR=10.8 $m^3$/min, FTP=46.5 MPa. When the sand stages were completed, the fractured wellbore was flushed with slick water at a pumping rate of 11.0 $m^3$/min.

Example 2

In a horizontal well, a bottom hole assembly (BHA) comprising a multistage perforating gun and a bridge (frac) plug was positioned in the horizontal portion of the well. Pumps were then engaged to pump down the separation fluid (water) at a pumping rate of 1.0 $m^3$/min at 2,160.0 m at 30 MPa and then continued to pump at a pumping rate of 2.0 $m^3$/min until the well opened up enough for to start pumping the acidic composition. At this point, 29.6 $m^3$ of separation fluid (water) had been pumped to form the separation layer. Pumping rate was reduced to 0.5 $m^3$/min and acid pumping commenced. A total of 5 $m^3$ of acid was pumped. The pumping rate was then increased to 2.0 $m^3$/min and 22.2 $m^3$ displacement fluid was pumped to displace the acid. All pumps were then shut down and, at this point, a total of 56.0 $m^3$ of water had been used.

The bridge plug was then set at a depth measurement (KB) measured in meters (m) of 3,728.0 mKB. The multistage perforation gun was then pulled up and the formation was first perforated at 3,722.0-3,722.25 mKB. This "pull and perf" procedure was repeated seven more times at depth intervals of 3,710.0-3,710.25 mKB, 3,698.0-3,698.25 mKB, 3,686.0-3,686.25 mKB, 3,674.0-3,674.25 mKB, 3,662.0-3,662.25 mKB, 3,650.0-3,650.25 mKB, and 3,638.0-3,638.25 mKB. After perforation was completed, the BHA was pulled to the surface and removed from the wellbore. At this point, the open casing pressure was 16.9 MPa. The acid was then displaced into the perforations by pumping a final volume of displacement fluid (water) at a rate of 2.75 $m^3$/min, with an acid response of 51.2 MPa to 41.4 MPa. Fracturing fluid (slick water) was then pumped downhole at increasing fluid rates up to 6.4 $m^3$/min, FTP=51.2 MPa. At this point, slick water sand pumping was started→25-600 kg/$m^3$, 30/50 sand (168.0 tonnes), FTR=12.0 $m^3$/min, FTP=49.6 MPa. Once the sand stage was completed, the wellbore was flushed with slick water at a pump rate of 12.0 $m^3$/min.

CLAUSES

Clause 1. A method for acidizing a formation, comprising: providing a wellbore in the formation; conveying a bottom hole assembly (BHA), said BHA at least comprising at least one perforating tool and a bridge plug, into the wellbore by means of a carrier line, including a wireline, a slick line, or coiled tubing, until the BHA reaches a desired location in the wellbore; pumping a volume of a separation fluid into the wellbore sufficient to submerge the BHA in the separation fluid; pumping a volume of an acidic composition to form a layer of acidic composition above the separation fluid; setting and shearing off the bridge plug from the BHA; positioning the at least one perforating tool of the BHA at the desired location in the wellbore requiring acidizing while ensuring that the BHA is still substantially separated from the acidic composition; activating the at least one perforation tool to perforate the wellbore and create perforations into the surrounding formation; removing the remaining tools of the BHA and carrier line from the wellbore; and pumping a volume of a displacement fluid into the wellbore to displace the separation fluid and allow the acidic composition to reach the perforations for acidizing the formation.

Clause 2. The method of any one or more of clauses 1-25, further comprising pumping a volume of a displacement fluid into the wellbore to form a layer of displacement fluid above the acidic composition layer.

Clause 3. The method of any one or more of clauses 1-25, wherein the displacement fluid comprises a fracturing fluid and, optionally, a proppant, that is pumped into the wellbore to displace the separation fluid and allow the acidic composition to reach the perforations to acidize the formation and to further fracture the perforations after acidizing to form fractures.

Clause 4. The method of any one or more of clauses 1-25, wherein the displacement fluid comprises an additional volume of separation fluid followed by a fracturing fluid and, optionally, a proppant that is pumped into the wellbore to displace the separation fluid and allow the acidic composition to reach the perforations to acidize the formation and to further fracture the perforations after acidizing to form fractures.

Clause 5. The method of any one or more of clauses 1-25, wherein the separation fluid comprises water.

Clause 6. The method of any one or more of clauses 1-25, wherein the wellbore is flushed with clean water when fracturing is completed.

Clause 7. The method of any one or more of clauses 1-25, wherein the method is repeated until a desired area of the formation is perforated, acidized and fractured.

Clause 8. The method of any one or more of clauses 1-25, wherein the method is repeated until a desired area of the formation is perforated and acidized.

Clause 9. The method of any one or more of clauses 1-25, wherein the wellbore is a horizontal wellbore and substantially an entire length of the horizontal portion of the horizontal well is perforated, acidized and fractured.

Clause 10. The method of any one or more of clauses 1-25, wherein the wellbore is a vertical wellbore, a deviated wellbore or a horizontal wellbore.

Clause 11. The method of any one or more of clauses 1-25, wherein both the separation fluid and the displacement fluid comprises water.

Clause 12. The method of any one or more of clauses 1-25, wherein the acidic composition comprises hydrochloric acid, hydrofluoric acid, an organic acid such as acetic acid or formic acid, or a combination thereof.

Clause 13. The method of any one or more of clauses 1-25, wherein the acidic composition further comprises a corrosion inhibitor.

Clause 14. The method of any one or more of clauses 1-25, wherein the fracturing fluid comprises friction reduced water Clause 15. The method of any one or more of clauses 1-25, wherein the proppant is added to the fracturing fluid and is selected from the group consisting of sand, treated sand or man-made ceramic materials.

Clause 16. The method of any one or more of clauses 1-25, wherein the wellbore comprises a production casing.

Clause 17. The method of any one or more of clauses 1-25, wherein the production casing is a steel pipe.

Clause 18. The method of any one or more of clauses 1-25, wherein the production casing is cemented in place in the formation.

Clause 19. The method of any one or more of clauses 1-25, wherein the at least one perforating tool is a perforating gun.

Clause 20. The method of any one or more of clauses 1-25, wherein the BHA further comprises a setting tool for setting and shear off the bridge plug.

Clause 21. The method of any one or more of clauses 1-25, the wellbore being a horizontal wellbore, wherein the separation fluid is also used to displace the BHA into the wellbore at the desired location in the wellbore while still ensuring that the BHA is submerged in the separation fluid.

Clause 22. The method of any one or more of clauses 1-25, wherein the displacement fluid of step (e) is added after the pumping of the acidic composition to further aid in displacing the BHA at the desired location in the wellbore while still ensuring that the BHA is submerged in the separation fluid.

Clause 23. The method of any one or more of clauses 1-25, wherein the separation fluid is selected from the group consisting of water, produced water (high salinity brine), friction reduced water, a gas including $CO_2$, $N_2$ and methane, a produced oil, frac oil, solvent, condensate, methanol, foam base fluids, surfactant based fluid and gelled water.

Clause 24. The method of any one or more of clauses 1-25, wherein the displacement fluid is selected from the group consisting of water, produced water (high salinity brine), friction reduced water, a gas including $CO_2$, $N_2$ and methane, a produced oil, frac oil, solvent, condensate, methanol, foam base fluids, surfactant based fluid and gelled water.

Clause 25. The method of any one or more of clauses 1-25, wherein the fracturing fluid is selected from the group consisting of friction reduced water, also referred to as slick water, high viscosity friction reduced (HVFR) water, linear gelled (guar, cellulose, xanthan, hydroxyethyl cellulose (HEC) polyacrylamide, hydroxypropyl guar (HPG), carboxymethyl hydroxypropyl guar (CMHPG)) water, gelled oil, cross-linked (borate, zirconium, titanate) gelled water, $CO_2$ polyemulsion or foamed water, $N_2$ foamed water, gelled methanol, oil/water polyemulsion and surfactant based fluids.

The scope of the claims should not be limited by the preferred embodiments set forth in the examples, but should be given the broadest interpretation consistent with the description as a whole. References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to," "at least," "greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method for acidizing a formation, comprising:

providing a wellbore in the formation;

conveying a bottom hole assembly (BHA), said BHA at least comprising at least one perforating tool and at least one bridge plug, into the wellbore by means of a carrier line, including a wireline, a slick line, or coiled tubing, until the BHA reaches a desired location in the wellbore;

pumping a volume of a separation fluid into the wellbore sufficient to submerge the BHA in the separation fluid;

pumping a volume of an acidic composition to form a layer of acidic composition above the separation fluid;

setting and shearing off the bridge plug from the BHA;

positioning the at least one perforating tool of the BHA at the desired location in the wellbore requiring acidizing while ensuring that the BHA is still separated from the acidic composition;

activating the at least one perforation tool to perforate the wellbore and create perforations into the surrounding formation;

removing the BHA and carrier line from the wellbore; and pumping a volume of a displacement fluid into the wellbore to displace the separation fluid and allow the acidic composition to reach the perforations for acidizing the formation.

2. The method of claim 1, further comprising pumping a volume of a displacement fluid into the wellbore to form a layer of displacement fluid above an acidic composition layer.

3. The method of claim 1, wherein the displacement fluid comprises an additional volume of separation fluid followed by a fracturing fluid.

4. The method of claim 3, wherein the separation fluid comprises water.

5. The method of claim 1, wherein the method is repeated until a desired area of the formation is perforated and acidized.

6. The method of claim 1, wherein the wellbore is a vertical wellbore, a deviated wellbore or a horizontal wellbore.

7. The method of claim 1, wherein both the separation fluid and the displacement fluid comprises water.

8. The method of claim 1, wherein the acidic composition comprises hydrochloric acid, hydrofluoric acid, an organic acid, or a combination thereof.

9. The method of claim 8, wherein a corrosion inhibitor is pumped with the volume of acidic composition.

10. The method of claim 1, wherein the wellbore comprises a production casing.

11. The method of claim 10, wherein the production casing is a steel pipe.

12. The method of claim 10, wherein the production casing is cemented in place in the formation.

13. The method of claim 1, wherein the at least one perforating tool is a perforating gun.

14. The method of claim 1, wherein the BHA further comprises a setting tool for setting and shear off the bridge plug.

15. The method of claim 1, the wellbore being a horizontal wellbore, wherein the separation fluid is also used to displace the BHA into the wellbore at the desired location in the wellbore while still ensuring that the BHA is submerged in the separation fluid.

16. The method of claim 15, wherein the displacement fluid of step (e) is added after the pumping of the acidic composition to further aid in displacing the BHA at the desired location in the wellbore while still ensuring that the BHA is submerged in the separation fluid.

17. The method of claim 1, wherein the separation fluid is selected from the group consisting of water, produced water, friction reduced water, a gas including CO2, N2 and methane, a produced oil, frac oil, solvent, condensate, methanol, foam base fluids, surfactant based fluid and gelled water.

18. The method of claim 1, wherein the displacement fluid is selected from the group consisting of water, produced water, friction reduced water, a gas including CO2, N2 and methane, a produced oil, frac oil, solvent, condensate, methanol, foam base fluids, surfactant based fluid and gelled water.

19. The method of claim 1, wherein the displacement fluid comprises a fracturing fluid.

20. The method of claim 19, wherein the wellbore is flushed with clean water when fracturing is completed.

21. The method of claim 19, wherein the method is repeated until a desired area of the formation is perforated, acidized and fractured.

22. The method of claim 19, wherein the wellbore is a horizontal wellbore.

23. The method of claim 19, wherein the fracturing fluid comprises friction reduced water.

24. The method of claim 19, wherein the proppant is added to the fracturing fluid and is selected from the group consisting of sand, treated sand or man-made ceramic materials.

25. The method of claim 19, wherein the fracturing fluid is selected from the group consisting of friction reduced water, also referred to as slick water, high viscosity friction reduced (HVFR) water, linear gelled water, gelled oil, cross-linked (borate, zirconium, titanate) gelled water, CO2 polyemulsion or foamed water, N2 foamed water, gelled methanol, oil/water polyemulsion and surfactant based fluids.

* * * * *